US011725361B2

(12) United States Patent
Trude et al.

(10) Patent No.: US 11,725,361 B2
(45) Date of Patent: Aug. 15, 2023

(54) SAFETY GRATING FOR RISER OF A SEPTIC TANK

(71) Applicant: Infiltrator Water Technologies, LLC, Old Saybrook, CT (US)

(72) Inventors: Gregory Trude, Bristol, CT (US); Paul R Holbrook, Old Saybrook, CT (US)

(73) Assignee: Infiltrator Water Technologies, LLC, Old Saybrook, CT (US)

( * ) Notice: Subject to any disclaimer, the term of this patent is extended or adjusted under 35 U.S.C. 154(b) by 492 days.

(21) Appl. No.: 16/814,157

(22) Filed: Mar. 10, 2020

(65) Prior Publication Data

US 2020/0385973 A1 Dec. 10, 2020

Related U.S. Application Data

(63) Continuation-in-part of application No. 15/432,780, filed on Feb. 14, 2017, now Pat. No. 11,427,400.

(60) Provisional application No. 62/295,408, filed on Feb. 15, 2016.

(51) Int. Cl.

| | |
|---|---|
| ***E02D 29/14*** | (2006.01) |
| ***E03F 5/06*** | (2006.01) |
| ***E02D 29/12*** | (2006.01) |
| ***E03F 5/02*** | (2006.01) |
| *E03F 11/00* | (2006.01) |

(52) U.S. Cl.

CPC ..... *E02D 29/124* (2013.01); *E03F 5/024* (2013.01); *E02D 29/14* (2013.01); *E03F 11/00* (2013.01); *E03F 2005/061* (2013.01)

(58) Field of Classification Search

CPC ... E02D 29/14; E02D 29/1427; E02D 29/127; B65D 90/10; E03F 5/06; E03F 2005/061

USPC ..... 404/25, 26; 52/19–21

See application file for complete search history.

(56) References Cited

U.S. PATENT DOCUMENTS

| | | | | |
|---|---|---|---|---|
| 2,803,348 | A * | 8/1957 | Bingham | E03F 5/06 210/498 |
| 4,101,154 | A * | 7/1978 | Kagstrom | E02D 29/1427 292/237 |
| 6,488,440 | B1 * | 12/2002 | Hill | E02D 29/1427 404/25 |
| 2001/0003886 | A1 * | 6/2001 | Mihalicz | E01C 23/06 52/394 |
| 2013/0336723 | A1 * | 12/2013 | McKinney | E02D 29/124 405/129.55 |

FOREIGN PATENT DOCUMENTS

| | | | |
|---|---|---|---|
| CN | 108049487 | * | 5/2018 |
| CN | 110158658 A | * | 8/2019 |
| JP | 0528006 A | * | 10/1993 |
| KR | 597032 B1 | * | 7/2006 |
| KR | 100669921 B1 | * | 1/2007 |
| KR | 100817777 B1 | * | 3/2008 |

(Continued)

*Primary Examiner* — Sunil Singh

(74) *Attorney, Agent, or Firm* — Charles G. Nessler

(57) ABSTRACT

A safety grating has an arch shape cross section and is useful within a riser having a frusto-conical shape wall which riser is attached to a septic tank or another structure. The grating comprises a hub and radially extending arms, one or more of which is rotatable relative to the hub length at a hinge joint, to decrease the size of the grating and enable installation of the grating by passing the grating a smaller end opening of a riser.

14 Claims, 8 Drawing Sheets

(56) References Cited

FOREIGN PATENT DOCUMENTS

| | | | | |
|---|---|---|---|---|
| KR | 100834377 | B1 | * | 6/2008 |
| KR | 20090066255 | A | * | 6/2009 |
| KR | 20090101415 | A | * | 9/2009 |
| KR | 20100044761 | A | * | 4/2010 |
| KR | 20110098696 | A | * | 9/2011 |
| KR | 20140002669 | U | * | 5/2014 |

* cited by examiner

SAFETY GRATING FOR RISER OF A SEPTIC TANK

This application is a continuation in part of patent application Ser. No. 15/432,780 filed Feb. 14, 2017, which claims benefit of provisional patent application Ser. No. 62/295,408 filed on Feb. 15, 2016.

TECHNICAL FIELD

The present invention relates to molded plastic structures comprised of interlocked rings, useful as risers and manhole chambers, for providing access to such as buried septic tanks and utility lines, or as sidewalls of plastic storage tanks.

BACKGROUND

A riser for a plastic or concrete septic tank used in wastewater treatment is one application for such tubular structures. Most commercially available risers are essentially short straight cylinders. Thus, they cannot be conveniently nested for economic shipment and storage.

The purpose of the riser is to provide a space which extends upwardly within soil, for example from the access port of a septic tank to, or near to, the surface of the soil in which the tank is buried. A riser desirably inhibits entry of surface water and soil into the tank. Risers have been sold commercially as separate rings which can be assembled as a riser assembly having a desired length (height). Often, there have been seals or other means aimed at preventing the passage of water at the joints between rings. Most commercially available risers are essentially short straight cylinders. Thus, they cannot be conveniently nested for economic shipment and storage.

Similar requirements are presented in connection with a hole in earth that provides access to a sewer line or other buried things by means of a manhole. A casing or liner, sometimes referred to as a chimney, extends downwardly from a manhole opening at the surface of the earth. In the present description the term riser shall be construed to embrace structures which are of the nature of risers for septic tanks and the like, are for manhole casings, and are for structures which are of the nature of sidewalls of vertical tanks.

A riser for septic tank application should have a minimum diameter which is no less than the diameter of the access port on the top of a septic tank, which commonly is of about 60 cm. In the past such risers have been provided either as a one piece structure, or as a multiplicity of circular rings which are commonly screwed or bolted to each other to form the desired height assembly. Good fit and seal between the joints of the rings is desirable, along with minimum labor of assembly. A riser desirably presents an uppermost surface suitable for a lid with a good seal configuration, particularly under conditions where surrounding soil may be prone to intruding into the seal region, as can occur when a lid is removed for septic tank maintenance purposes. There is a further need for a means of connecting any new-configuration riser to the opening of existing-design septic tanks and the ends of large diameter pipe-ends.

In recent times, there has been heightened consideration on providing means to hinder the chance of a small person falling into the large diameter opening of a typical septic tank riser, for example if the riser lid is removed by a person who is not a tradesman skilled in the art. It is desirable of having the option of a safety grating within a riser, but as will be appreciated from the description herein, when risers have a considerable frusto-conical shape, a simple flat grating will not be readily or conveniently installable at the time when the installer is ready to put the lid on a completed septic tank installation and leave.

In another application for articles of the present invention, a generally cylindrical plastic tank for holding liquids or solids may have a vertical axis and sidewall configured in the same way as a riser for a septic tank; that is, the sidewall is comprised of connected-together rings.

SUMMARY

An object of the invention claimed in this application is to provide a safety grating that is particularly useful with plastic risers that are comprised of interconnected frusto-conical riser segments, which riser has a lengthwise-undulating wall and varying inside diameter, and the grating is to be inserted through an upper end opening that is smaller in diameter than the diameter of the riser at the home position of the grating.

In accord with an invention, an exemplary grating for use within a riser comprises a hub and a multiplicity of arms attached to and extending radially outward from the hub. At least one of the arms, and optionally more than one arm, is hinged where it attaches to the hub, or at a location somewhat spaced apart along the length of the arm from the hub. Thus, the grating can be diminished in exterior dimension sufficient to enable the grating to fit through a smaller-opening end of a frusto-conical riser. When placed at its home position within the concavity of a riser having its frusto-conical wall facing upwardly, so the arms may be set upon a step or other engagement feature, and the grating will have an arch shape cross section.

Further in accord with the invention claimed in the parent application hereof, use may be made of individual risers and of assemblies of identical risers. Each riser has a tapered side wall; that is, the circumscribing wall is in the shape of a truncated hollow cone, and a riser assembly has a wall that is undulating in the lengthwise direction. Each riser has a first lengthwise end having a first diameter, and a second lengthwise end having a smaller second diameter. Each embodiment of riser end comprises a plurality of tabs circumferentially spaced apart by rim segments.

In embodiments of the invention, the riser like those just described comprises a wall having a circumferential step which preferably is closer in diameter to the smaller diameter second end than to the larger diameter first end, for receiving the legs of a grating.

The foregoing and other objects, features and advantages of the present invention will become more apparent from the following description of preferred embodiments and accompanying drawings.

DESCRIPTION

In the present invention molded plastic riser articles (sometimes referred to as rings) can be used individually or as assemblies. As will be seen, the type of risers disclosed herein have inward or outward tapering walls, also referred to as conical walls. (While the risers have a frusto-conical shape, for simplicity they are in short referred to as "conical.") Also for simplicity of description, the risers and riser assemblies are often described herein using terminology applicable to cylindrical objects. While the invention is described in terms of circular rings/risers and associated safety gratings, the scope of the invention includes articles which have walls which are non-circular, e.g. oblong; and those shall be considered equivalents to the circular articles that are described.

The first part of this description concentrates on an exemplary product and application, namely a riser for a septic tank within which a safety grating may be used. A riser is an open ended structure which may be closed by a lid when positioned on a tank. In the present invention, a riser may be mated with one or more other risers to form a riser assembly. In the art, a riser assembly may be also referred to simply as a riser. In this description and elsewhere a single riser piece may be alternatively referred to as a ring.

The disclosures of commonly owned patent application Ser. No. 62/295,408, filed Feb. 15, 2016, entitled "Multi-ring plastic riser with tab connectors", and U.S. Pat. No. 10,442,617 entitled "Multi-ring plastic storage tanks and risers" (the '617 patent) are hereby incorporated by reference.

Figure 1:
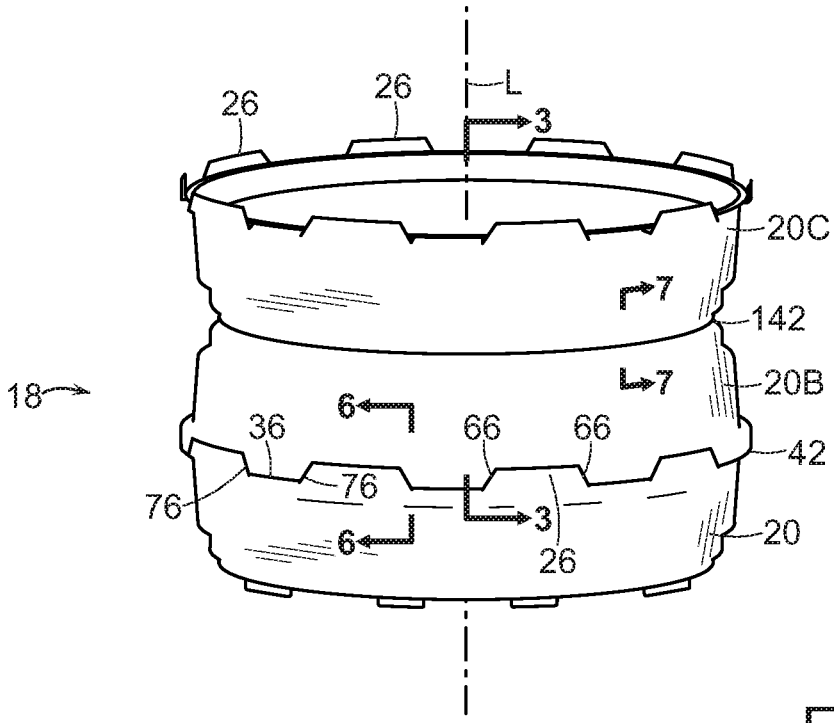
FIG. 1 is a perspective view of a riser assembly comprised of identical risers.
Figure 2:
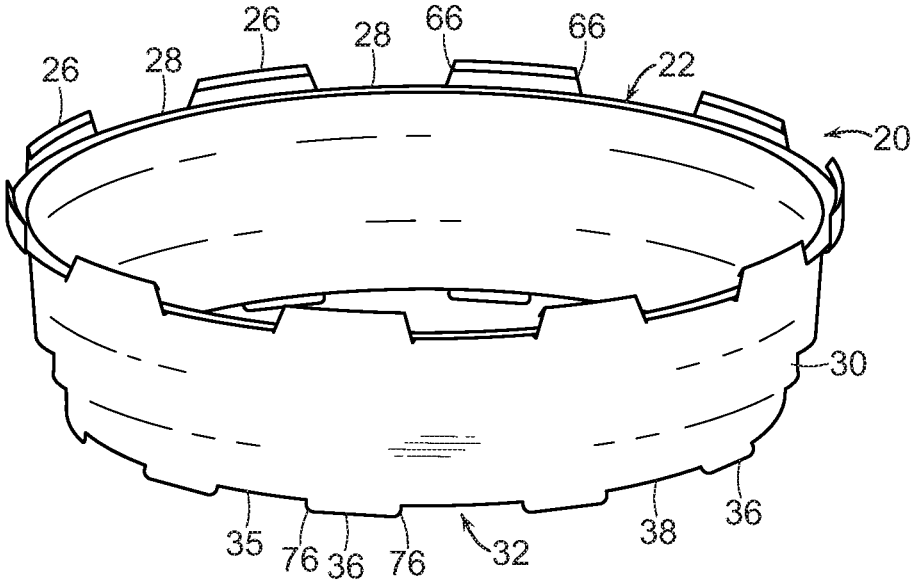
FIG. 2 is a perspective view of a riser which is part of the assembly of FIG. 1.
Figure 3:
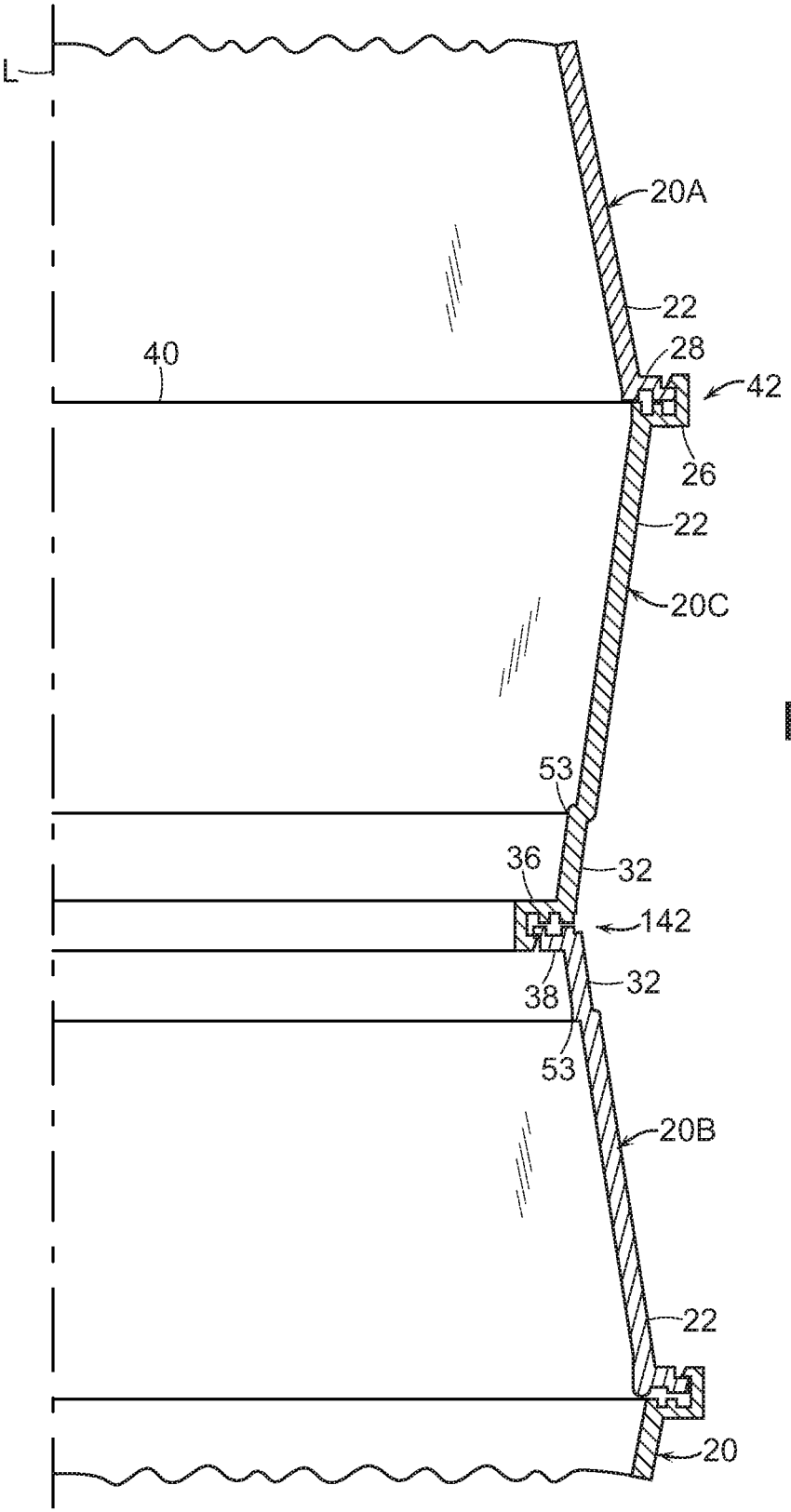
FIG. 3 is a partial vertical cross section through the riser assembly of FIG. 1, with an additional riser added at the top of the assembly.

FIG. 1 is an elevation perspective view, showing three identical risers 20, 20B, 20C that are joined to each other as riser assembly 18. A single riser 20 is shown in FIG. 2. FIG. 3 is a cross section through the assembly of FIG. 1, with addition of a further riser 20A. The small end of riser 20B mates with the small end of riser 20C at joint 142. The large end of riser 20A mates with the large end of riser 20C at joint 42. The wall of the riser assembly undulates in the lengthwise direction, so the wall is close to the central axis at circumferential joints 142 and distant at circumferential joints 42.

A riser assembly of the present invention may comprise two or more mated and latched-together articles. A riser assembly may sometimes be simply called a riser herein, particularly when the assembly is installed in a working position. When installed on a septic tank, a riser assembly is typically fastened to a fitting around the opening in the top of the tank and the assembly has a lid closure at its top. An exemplary lid closure is consistent with the lid shown in FIG. 8-10 of the aforementioned '617 patent.

An exemplary riser 20 may have a vertical height of about 15 cm (about 6 inch), a larger diameter end of about 69 cm (about 27 inch) and a smaller diameter end of about 58 cm (about 23 inch). Other risers may have heights in the range 2 to 18 inches (5 to 46 cm). Joints between several identical risers 20 are formed by tabs on one part that engage rim segments on the mating part by latching to them. An exemplary riser is preferably made of injection molded thermoplastic, such as polyethylene or polypropylene, with a wall thickness of about 4.5 mm (about 0.18 inches). Alternative plastic materials may be used.

Riser 20 has a lengthwise central axis L, around which is centered a wall 30 that generally has the shape of a truncated hollow cone. The wall of riser 20 has opposing ends 22, 32. End 22 has a larger diameter than does smaller end 32. The wall of an exemplary ring is preferably inclined at an about 7 degree angle to the lengthwise axis L, more generally, preferably within the range 5-20 degrees.

Figure 5:
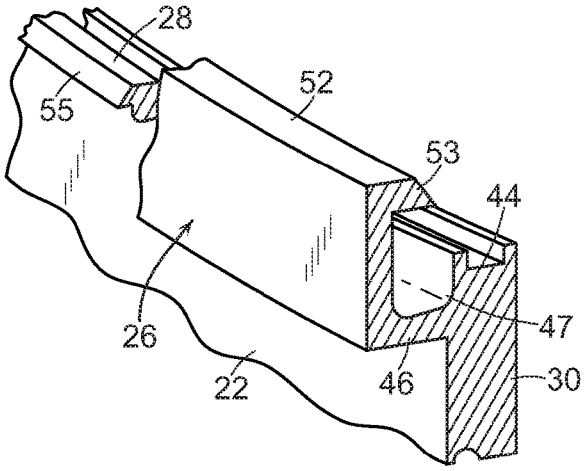
FIG. 5 is another perspective view of a portion of the large end of the riser in FIG. 3.
Figure 6:
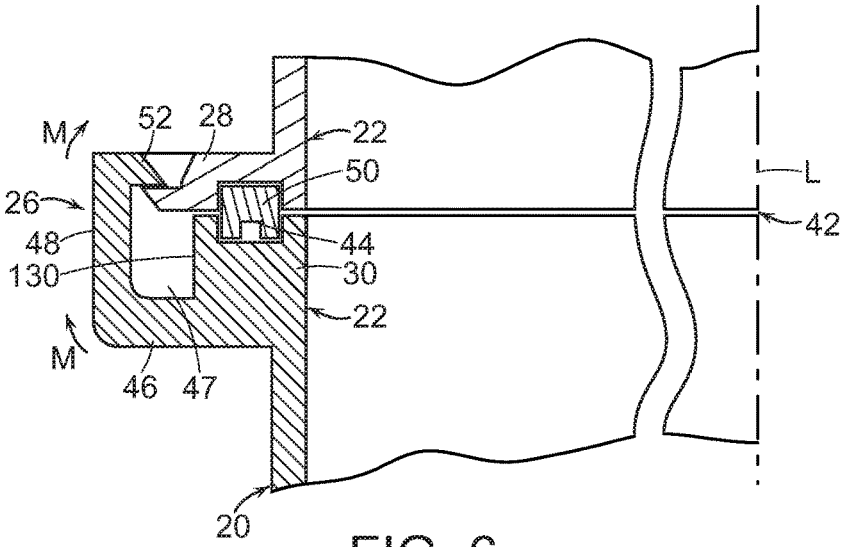
FIG. 6 is a vertical cross section through the large-end joint region of the riser assembly of FIG. 1.

As best seen in FIGS. 1, 2 and 5, the larger end 22 of a riser 20 is characterized by a plurality of tabs 26 which are circumferentially spaced apart by rim segments 28. Rim segments may be referred to as simply "rims" hereafter. The tabs extend in the lengthwise direction from the exterior surface of the wall of the riser. Each tab has a lip 52, for latching onto the rim segment 28 of a mated like riser. The inner edges of the lips are disposed around a circle. The outer edges of the rim segments are disposed around a circle which is congruent with the circle of the lip edges. A joint 42 between risers is formed when the plurality of tabs 26 of one riser are engaged with a plurality of rims 28 of a mating riser. Likewise, joints 142 are formed between mated riser smaller ends. See the cross sections at joint locations in FIG. 3. FIG. 6 shows an added gasket 50 captured in a circumferential channel 44 that is associated with joint 42. Gaskets may also be included in joints 142.

FIG. 3 shows an optional step 53 in the wall 30 proximate the small end of riser 20C; this is discussed below in connection with a safety grating which optionally rests on the step.

Figure 7:
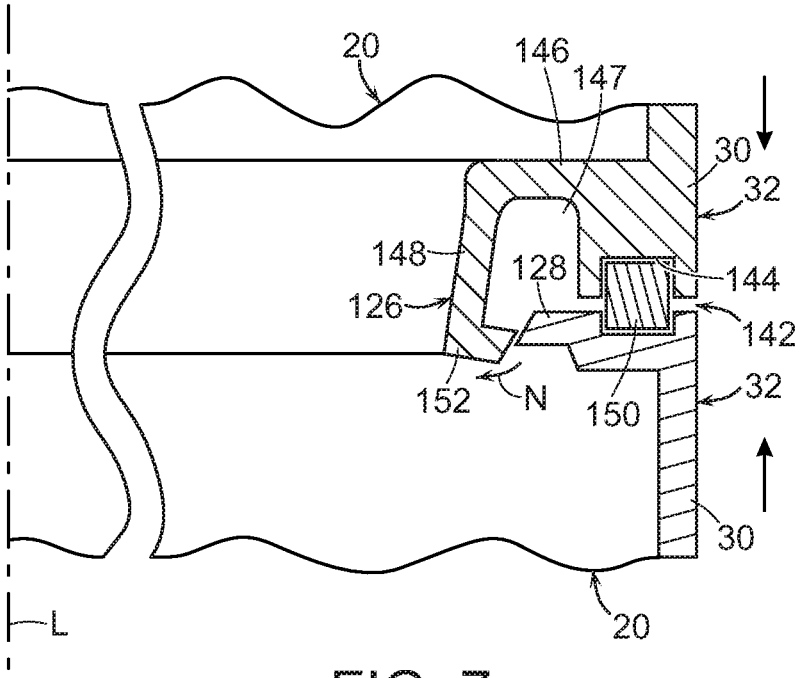
FIG. 7 is a vertical cross section through the small-end joint region of the riser assembly of FIG. 1.

Referring to FIGS. 1, 2, and 7, the smaller end 32 of a riser 20 has many similarities with larger end 22, but also some differences. Smaller end 32 is characterized by a plurality of tabs 36 which are circumferentially spaced apart by rim segments 38, which may be referred to simply as rims hereafter. Joint 142 is formed when the plurality of tabs 36 are engaged with a plurality of rims 38 of a mating riser. Each tab 36 has an outward facing lip 152. When two risers are mated, each lip 152 engages a rim 128. See the assembly cross section at joint 142 in FIG. 3 and FIG. 7. A gasket 150 is preferably captured within a circumferential channel 144 at the circumferential end of the wall of each riser, to seal joint 142. See FIG. 7.

When used, gaskets 50, 150 are preferably made of a rubber or elastomer material, for example EPDM having a Shore A hardness number of about 30. Optionally, where resistance to water passage through the joint is not important to the user, the risers can be assembled without the use of a gasket, and risers may be constructed without a channel 44. See FIG. 6A, discussed below.

Exemplary riser 20 has ten tabs 26, 36 at each end. Preferably, the tabs at one end are aligned in the lengthwise direction with the tabs at the other end of the riser. In other embodiments of the invention, there may be fewer or more tabs; and there may be a different number of tabs at one end, compared to the other end.

Figure 4:
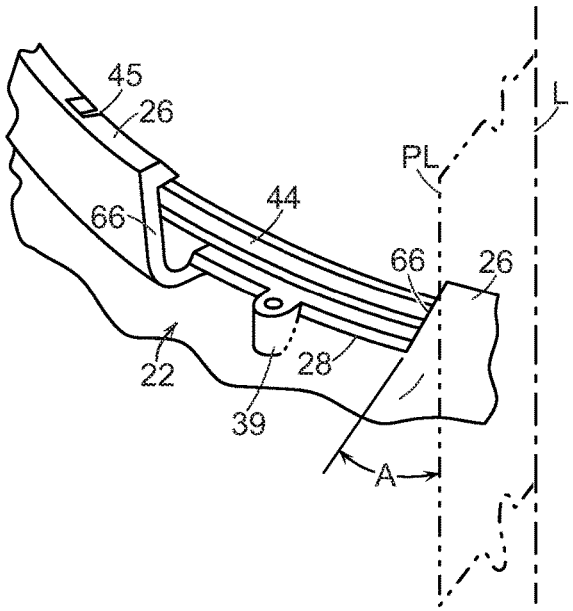
FIG. 4 is perspective view of a portion of the large end of the riser in FIG. 3.

FIGS. 4 to 7 illustrate certain features of the ends of a riser which enhance the convenient making of a good joint with a like riser. (This portion of the description interchangeably applies to the small ends and large ends of risers.) FIG. 4 and FIG. 5 are perspective views of portions of the larger end 22 of riser 20. They show that each tab 26 has an inward facing lip 53 and that rim 28 runs circumferentially between two spaced apart tabs. Also, each tab 26 has circumferential-direction ends 66 which are canted at angle A to a lengthwise diametrical plane PL, shown in phantom, within which plane lies lengthwise axis L. The angled ends 66 enable easier engagement of the tabs of two mated risers, as each tab of a first riser nestles into the space between the tabs of the mating second riser, so that each tab engages a rim segment. FIG. 1 shows that in the resultant assembly 18, the angled ends 66 of each tab 26 of a first riser 20 abut the angled ends 76 of spaced apart tabs 36 of the second riser, so that interleaved tabs are continuous around the circumference of the joint 42.

With particular reference to FIG. 5, lip 52 of tab 26 has an inner edge 53 which is angled with respect to the diametrical plane of the riser, so that the tab is thrust elastically outwardly when the lip of the tab first engages with rim 28 of a mating riser. For the same reason, the outer edge 55 of rim 28 is angled with respect to the diametrical plane.

FIG. 6 is a cross section through the riser assembly 18 at joint 42. FIG. 6 shows how the large ends 22 of risers 20 mate; the small ends will mate comparably. FIG. 6 shows lip 52 of tab 26 is engaged with rim 28. Seal 50 is captured in the groove 44. As pictured in cross section, tab 26 has a body 48, which is the lengthwise extending portion of the tab (i.e., the vertical portion in FIG. 6). Tab body 48 is an arc-shape structure that runs circumferentially, congruently with wall 30 and with the rim segments of the riser. One lengthwise end of tab body 48 is connected to the exterior wall of riser end 22 by radially inward-running web 46 (which is a horizontal section shown in FIG. 6). The other lengthwise end of the tab body extends beyond the end of the wall where the joint 42 is formed. As described in more detail below, in a preferred injection molded riser, the web 46 may be discontinuous in the circumferential direction.

The combination of elements 48, 46 and local portion 130 of wall 30 defines circumferentially-running channel 47 (which has a length nominally equal to the tab width). Channel 47 provides an advantageous arrangement for the following reasons: When force is applied to the risers, to separate the risers from each other at the joint 42, a bending moment (represented by the curved vectors M) is created in web 46. That moment has the effect of thrusting section 48 and lip 52 radially inwardly, toward the central axis L of the riser, better to engage rim 28. That enhances the resistance of the joint to separation, compared to the resistance which the assembly would have if channel 47 and section 46 were not present, i.e., compared to the structure shown in FIG. 6A. Secondly, by increasing the effective length of the tab body, even without the foregoing phenomenon, deflection of tabs by contact with rim segments, and thus engagement of mating parts, is made easier.

Figure 6A:
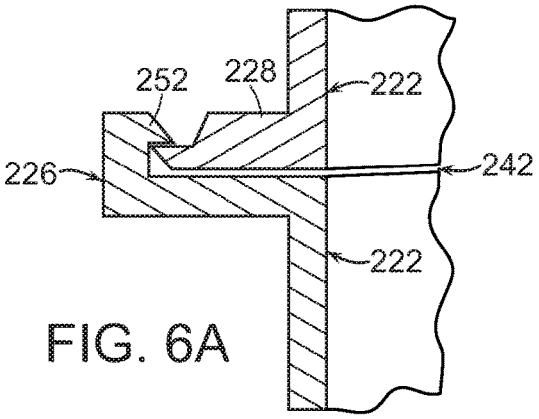
FIG. 6A is a view like FIG. 6 showing a joint which lacks a seal and a channel between the wall and latching tab.

FIG. 6A shows two mated risers 222 and illustrates an alternate embodiment of the invention. One of a plurality of tabs and rim segments is shown. Joint 242 is formed between two mated risers 222 when lip 252 of tab 226 engages rim segment 228. First, the risers 222 lack any optional circumscribing channel for a seal between the mating parts. Second, there is no channel like channel 47 that spaces the tab body away from the end of the wall, as there is in the embodiment shown in FIG. 6. See also FIG. 11 and related discussion, where the tab body is also not spaced apart, but is a lengthwise continuation of a portion of the wall.

FIG. 7 is a cross section through the riser assembly 18 at joint 142, showing how the small ends 32 of risers 20 mate. The ends are shown as they are being moved toward each other to their final joined-together configuration, as indicated by the vertical arrows. Tab 126 has a construction like tab 26. Lip 152 is at the end of tab body 148, which is connected to web 146 that extends radially from the wall 30 of riser 20 at small end 32. (As mentioned, lip 152 faces outwardly from the center of the riser, which compares with inward-facing lip 52 of tab 26.) In FIG. 7, the engagement of lip 152 with rim 128 and movement of the risers toward each other causes lip 152 to be deflected radially inwardly as indicated by arrow N. This action is facilitated by the angled terminal ends of lip 152 and rim 128, previously discussed.

Once the mating features of the ends are engaged, the risers cannot conveniently be separated other than by use of tools which pull all tabs from engagement with the mating rims. It is not expected that a user will often seek to separate the risers once they are joined to each other.

Referring again to FIG. 4, each of the plurality of rim segments 28 may be interrupted by a boss 39, which is nominally in the center of the rim segment. Boss 39 is shaped so it can receive a screw, thus enabling the end of the riser to be fitted with a screw-attached lid. When boss 39 is present, a notch 45 is preferably present in the lip of the tab which is shaped to engage the rim segment, to accommodate the boss 39 and screw.

Figure 8:
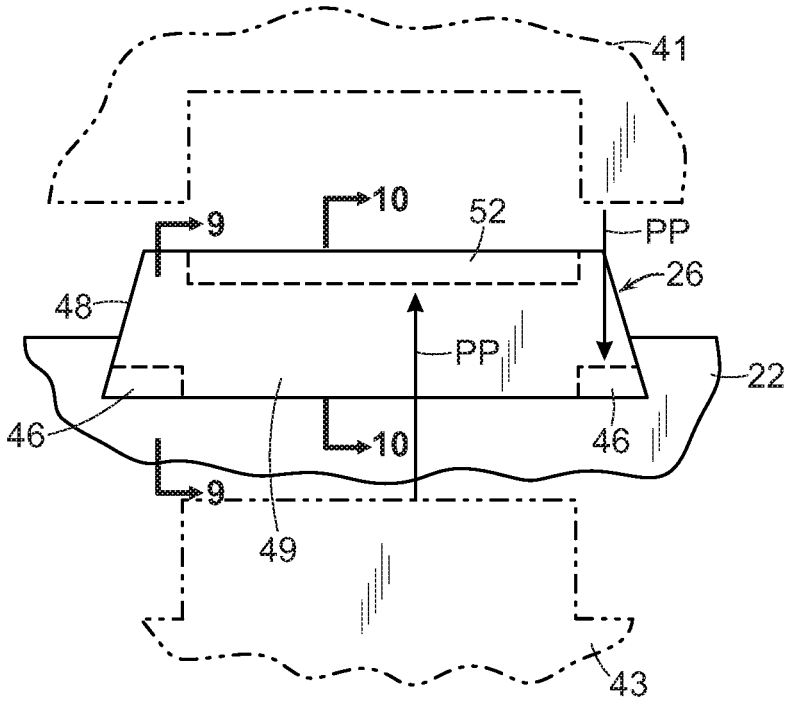
FIG. 8 is a side view of the end of a riser showing a latching tab and (in phantom) portions of tooling which enables the riser to be injection molded.
Figure 9:
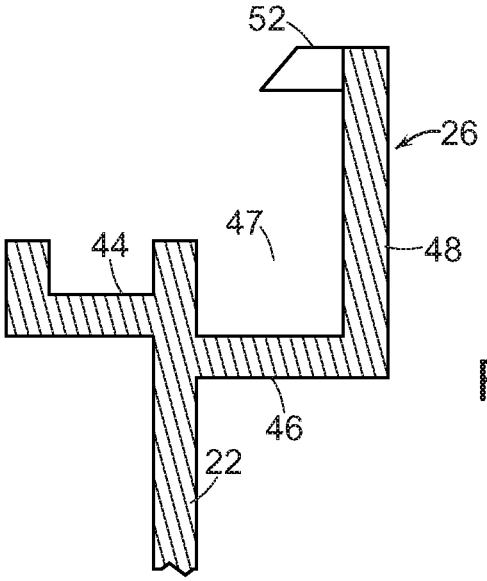
FIG. 9 is a vertical plane cross section through the structure of FIG. 8, near the end of the tab.
Figure 10:
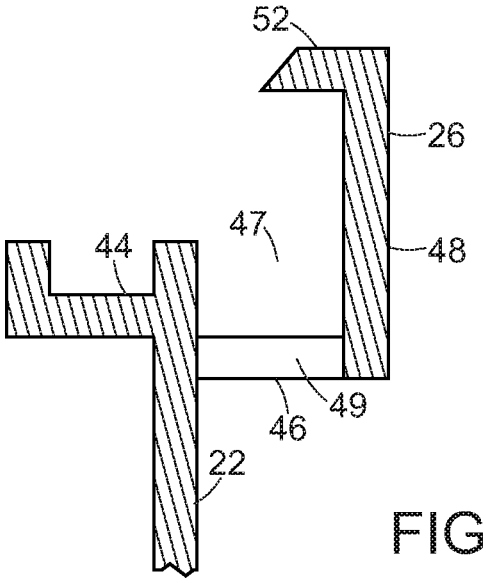
FIG. 10 is a vertical plane cross section through the structure of FIG. 8, near the middle of the tab.

FIG. 8-10 show in more detail other aspects of a tab of a preferred injection molded riser 20. The tab is mated to the wall of the riser by a web that is comprised of two spaced apart portions, which facilitates manufacture. FIG. 8 is a side view of a portion of the end 22 of a riser showing tab 26. FIG. 9 and FIG. 10 are vertical plane portions through the tab and riser end shown in FIG. 8. Also shown in FIG. 8, in phantom, are mold parts 41, 43 in their spaced apart (or "open mold") condition. The arrows PP show how the mold parts 41, 43 move toward each other when the mold is closed so plastic can be injected into the mold.

With reference to FIG. 8, 9, 10, there is a space 49 between the two circumferentially spaced-apart portions of web 46. Space 49 is created by mold part 43. When the tab has the configuration which comprises space 49 that enables mold part 43 to create the underside surface of lip 52. An alternative embodiment of tab may have a web 46 which is continuous from one circumferential edge of the tab to the other. In such case, a more complex mold may be necessary for efficient injection molding.

Figure 11:
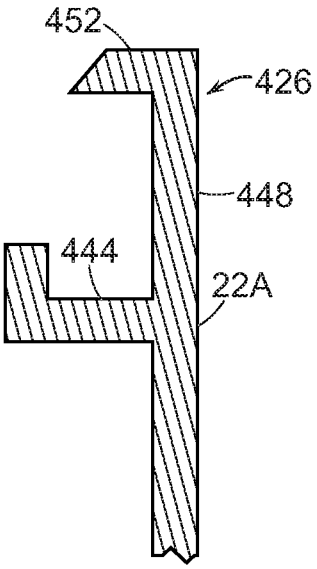
FIG. 11 is a view like FIG. 9, showing an alternative embodiment of tab where the tab is not spaced apart from the wall at the end of the riser.

FIG. 11 is a view like FIG. 9, showing an alternative embodiment tab 426 at the large end of a riser. There is no channel like channel 47; tab body 448 is a continuation of a portion of the riser wall. Lip 452 overhangs the channel 444 within which a seal will be placed prior to a joint between risers being made.

The following part of this description discloses a safety grating that is particularly useful with the foregoing types of risers. A grating of the present invention may be used with risers other than those described herein.

Often, an installer will want to wait until near the end of the installation process to install the grating, not wanting the impediment to access of inside the tank during installation. The risers described above have one end that is smaller than the other and an assembly has a lengthwise-undulating wall. So, if in an assembly of risers the small end of a riser is at the top, the grating has to pass through the small opening and in order to be set within a larger lower-down portion of the riser assembly.

Figure 12:
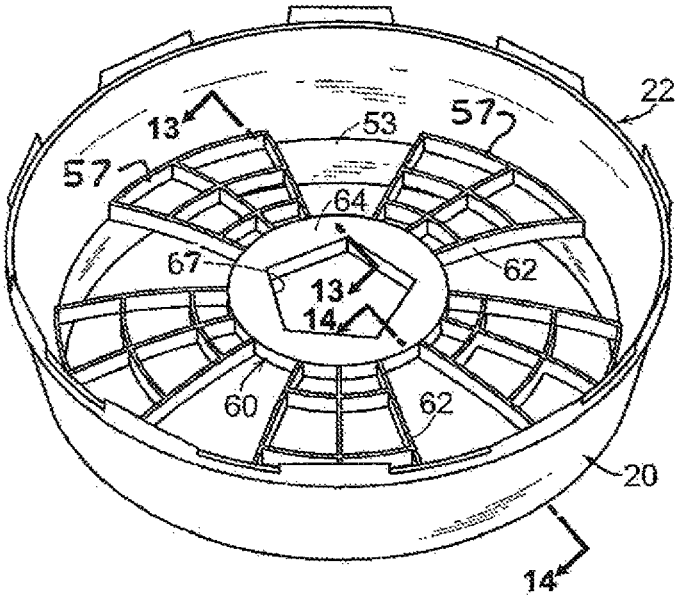
FIG. 12 is a perspective view of a riser with a safety grating positioned within the bore of the riser.

FIG. 12 is a perspective view showing grating 60, an embodiment of the present invention, within the concavity of a riser 20 that has its larger end 22 facing upwardly. (The phantom riser 20P and grating 62P shown in the Figure are discussed below.) Grating 60 comprises hub 64 and a multiplicity of arms 62 extending radially outward from the hub, at least one of which is hinged for movement in the vertical plane direction. A grating 60 may be made of the same material as the material of the riser, e.g., polyethylene or polypropylene.

FIG. 12 shows that, with radial distance from the hub, the circumferential direction width of each arm increases; and each arm free end comprises a curved rib 57. The spaces between the arms and within the lattice work of an arm, and the opening in the hub, aim to be small enough to impede a small person, such as an ambulatory child, from falling through the riser, should the lid be left off the riser or should the lid be improperly removed when no installer is present. The opening 67 in the hub upper end is part of a lengthwise passageway through the hub that may be large enough to enable a clean-out hose to be passed through the hub. In an alternative embodiment, the arms may be solid rather than lattice-like, although that disadvantageously would increase weight and cost.

In the grating embodiment 60, hub 64 has a pentagonal shape opening 67 and five attached arms. A grating within the scope of the present invention may have a hub with a center opening and passageway which are of a different shape, including circular, or there may be no opening. A grating within the scope of the present invention may have arms which differ in number from five. For example, 2, 3, 4, 6, or more arms may be used.

Figure 14:
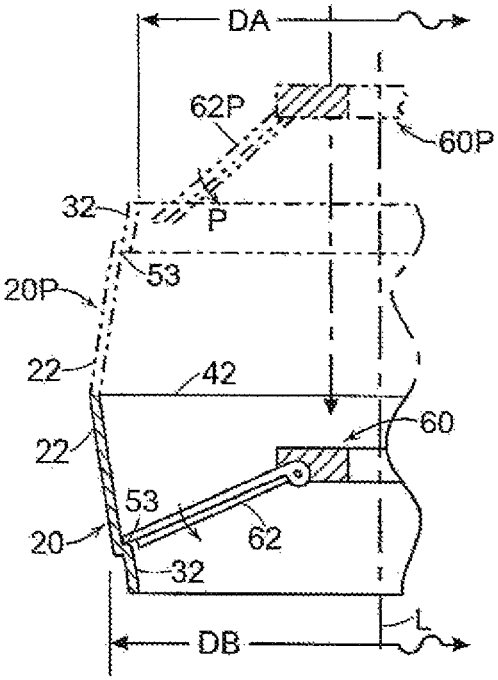
FIG. 14 is a partial vertical cross section of the assembly of FIG. 12, showing in phantom an additional riser, along with the grating as it was being inserted into the riser assembly from the top.

The lateral dimension of the hub 64 where the arms attach, and the lengths of the arms 62 including any hinge arm which is extended for use when the grating is in its home position within riser 20, provide grating 60 with arch shape in vertical plane cross section, when the grating is in place at its home position within the riser 20, as shown in FIG. 14. The free end of each arm contacts the interior surface of the wall of riser 20 and thus the free ends lie around a circle. At the grating home position, the free ends of the grating arms are constrained from outward and downward movement because they each comprise a curved rib that presses press against the inward tapering riser wall. Thus, a person or like thing coming down the riser from above should be substantially hindered from moving past the grating.

Preferably, there is a step 53 on the interior of the wall of the riser, as shown in FIG. 14, for engaging the free outer ends of the arms. That makes easier horizontal plane positioning of the grating and supports the grating against vertical loads. The outer ends of some or all arms may be screwed to the riser wall to avoid inadvertent dislocation of the legs or of the grating as a whole. An alternative engagement feature to said step may be used. For example, individual raised buttresses, or pockets, or holes in the wall, can be provided, to receive mating features at the ends of the arms.

Figure 13:
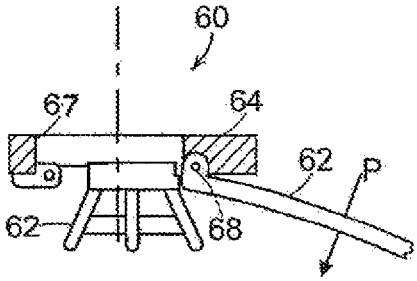
FIG. 13 is a partial vertical cross section of the grating shown in FIG. 12.

In an embodiment of grating, the arms are preferably separately molded from the hub; and an end of each arm 62 is fixedly attached to the hub by means such as pins or screws. Alternatively, except for the at least one hinged arm, the arms may be integral with or welded to the hub. The side elevation view of FIG. 13 shows how one arm 62 is pivotable at hinge 68, where the first end of the arm attaches to the hub, so the arm can rotate in the vertical plane, as indicated by the arrow P.

FIG. 14 is a partial vertical cross section of the grating and riser assembly shown in FIG. 12 along with a second riser 20P. A grating is also shown as phantom grating 62P, to illustrate that when the grating is installed, the grating is passed through the small upper end opening of the assembly, aided by the rotation of at least one arm.

For reference, FIG. 14 shows that riser 20P has a small end opening that is equivalent in size to an imaginary circle having an effective diameter DA. "Effective diameter" as used herein refers to the diameter of such an imaginary circle. In the invention, hinging of one or more arms enables the grating to have an effective diameter which, at least locally, is smaller than the diameter DA during the time when the grating is being inserted into the top riser. When the grating reaches its home position, the ends of the arms fit within an imaginary circle having an effective diameter DB, which is larger than diameter DA.

During the process of installing a grating, an exemplary hinged arm 62P is rotated about the hinge point as the hub and such fixed arms as are present are tilted. Rotating the one or more hinged arms downwardly from the hub reduces the exterior dimension of the grating locally. Then, as the grating is moved downwardly to the grating home position with riser 20, the hinged arm is rotated back, so all the arms extend the same distance from the hub and the hub length axis is aligned with the riser length axis L.

When a grating like grating 60 has four fixed arms and one arm is hinged to rotate in a vertical plane, the effect of rotating the one arm will be to decrease by about 10 percent (or about 35 degrees of arc) of the imaginary circle circumference which characterizes the terminal ends of all the arms of a grating when it is in its home-position, i.e., a circle having the diameter DB. The two spaces on either side of the hinged arm each will contribute an about 10 percent (about 35 degrees) more of useful decrease in circumferential dimension of the grating—for a total of about 30 percent (about 105 arc degrees). In short, when an at least one arm is rotated, the dimension of the grating is less than the imaginary circle dimension for about 10 to 30 percent of the circumference of the imaginary circle.

Springs (not shown) may be employed to bias a hinged arm in the outward, or most-extended, direction. For example, a torsion spring may be put around the pin at the hinge joint, or compressible elastic bumpers may be used to resist the inward or collapsing motion of the arms. When a grating has more than one hinged arm, the movement of one arm may be interlocked with the movement of an adjacent arm, to cause all the hinged arms to move radially outward or inward in coordination. Interlocking may be accomplished by a circumferentially extending tang affixed to an arm to slidingly engage an adjacent arm.

Figure 15:
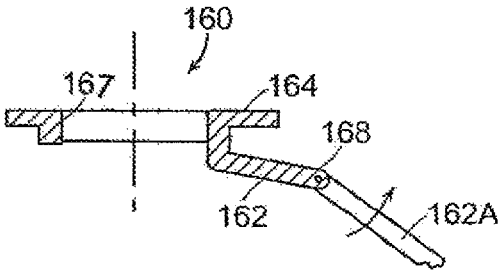
FIG. 15 is a view like FIG. 13, showing an alternative embodiment grating.

In another embodiment of the invention, illustrated by FIG. 15, grating 160 comprises hub 164 having bore 166. At least one hinged arm comprises of a portion 162 that is fixedly attached to the hub. A second arm portion 162A is attached to the first portion by hinge joint 168. As with the embodiments previously described, a grating in accord with grating 160 has at least one hinged arm; and there may be more than on hinged arm.

The following paragraphs describe adapters which are particularly useful with the foregoing kinds of risers which have tapered walls, also referred to as conical walls.

Figure 16:
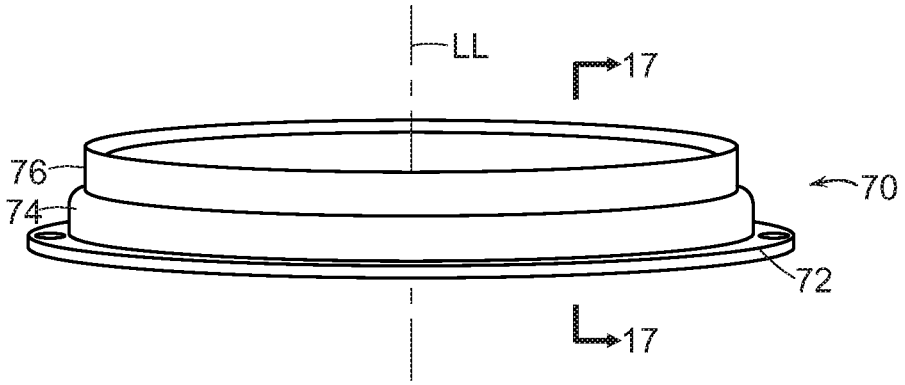
FIG. 16 is a perspective view of an adapter for connecting a riser to the top of a septic tank or to the end of a piece of pipe.
Figure 17:
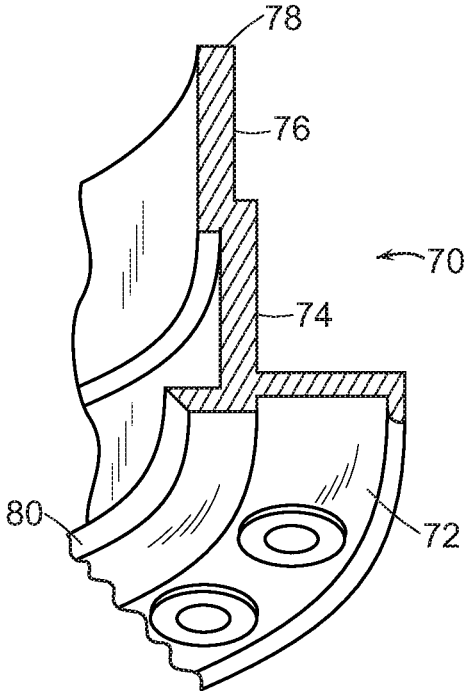
FIG. 17 shows a portion of the adapter of FIG. 16 in partial vertical cross section.

FIG. 16 shows in perspective an exemplary adapter 70 having lengthwise central axis LL, and FIG. 17 is a partial cross section. Adapter 70 which has multiple uses, including (a) enabling attachment of the small end of a riser of the present invention to the top of a tank, such as a septic tank; (b) enabling attachment of a corrugated pipe or prior art riser or other future riser to the top of a tank; and (c) enabling a riser of the present invention to be attached to the end of a corrugated pipe or to a prior art riser, or vice versa.

Adapter 70 has a first larger end comprising flange 72 and a second end 78 comprising cylindrical section 76 which has a diameter smaller than the outside diameter of adapter flange 72. An intermediate size section 74 connects the section 76 with the flange. Within the bore of the first end flange is inward projecting ledge 80. Ledge 80 has an inside diameter and other dimension which preferably corresponds with the effective diameter of the rims 128 at the smaller end 32 of a riser 20.

Figure 18:
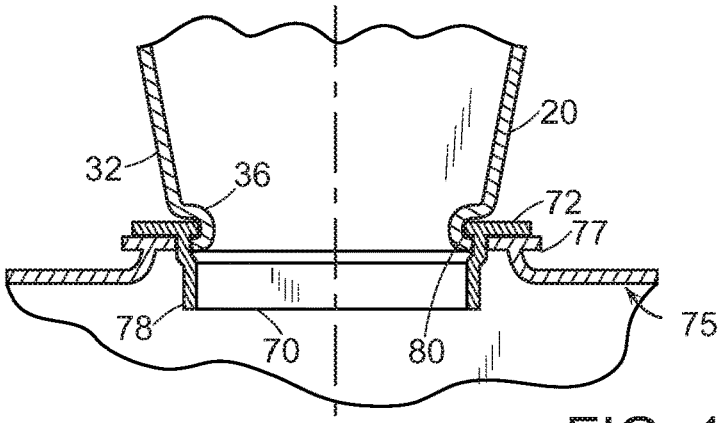
FIG. 18 is a partial cross section showing how a taper wall riser is connected to the top of a septic tank by means of an adapter of FIG. 16.

When a septic tank has an opening with a top flange that has a suitable inward extending rim, the small end of a riser 20 of the present invention can be snapped onto the tank top flange, and the tabs will latch onto the rim. When the tank does not have such a suitable top flange, as illustrated by flange 77 of tank 75, the adapter flange 72 can be screwed or otherwise attached to the flange 77, as shown in the partial vertical cross section of FIG. 18. In FIG. 18, tabs 36 of riser 20 are shown after they have been engaged with ledge 80 of the adapter.

Figure 19:
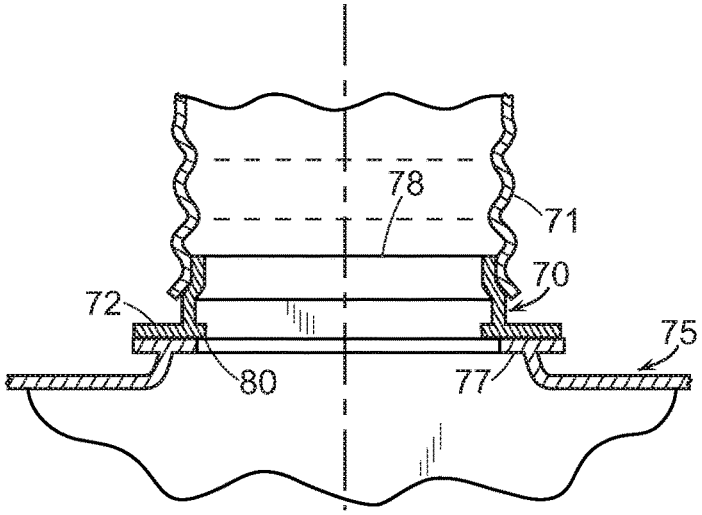
FIG. 19 is a partial cross section showing how a piece of pipe is connected to the top of a septic tank by means of an adapter of FIG. 16.

FIG. 19 shows how the adapter 70 can be used to mount a piece of pipe (or other item having a suitable diameter) on the top of a tank. The small end 78 of adapter 70 faces in the upward direction (away from the interior of the tank 75) and the flange 72 is screwed or otherwise attached to the rim 77 at the septic tank opening. A corrugated pipe 71 is shown mounted on the section 76 at the small end 78 of the adapter; alternatively, the pipe fits the intermediate section 74.

Figure 20:
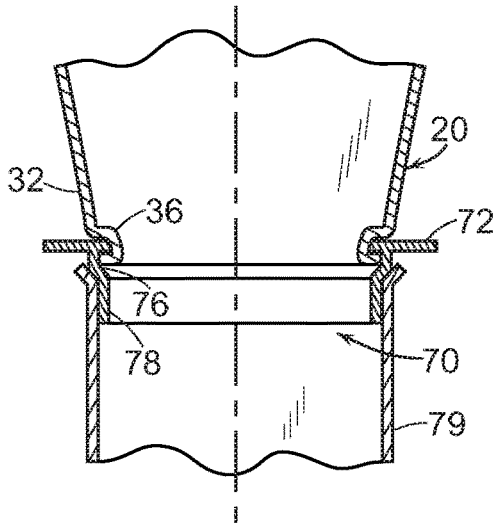
FIG. 20 is a partial cross section showing how a taper wall riser is connected to the end of a piece of pipe by means of an adapter of FIG. 16.

It is sometimes desired replace a portion of a prior art riser that is spaced apart from the tank, or to add to the length of a prior art riser. FIG. 20 shows how the small end 78 of adapter 70 is inserted into the top of a riser 79 that does not have an end that mates with a riser of the present invention. Adhesive and or radially-running screws may be used to fasten adapter 70 to the original in-place riser 79. Then riser 20 of the present invention is inserted into the opening of flange 72 and the tabs at the small end 32 of the riser become engaged with the ledge 80 of the adapter.

Assembled structures embodying features of the present invention may be put to other uses including, for example, manhole sleeves for access to subterranean chambers. An open ended hollow article like a riser, made in accord with the invention, may be fitted with a bottom closure (and optionally a top also), thus making the article into a bucket or tank like vessel, suitable for storing water, other liquids, or solid items. A claim to a riser shall be construed as comprehending a structure which may be used for a manhole in the earth or other material, or for a structure which forms part of a vessel. For convenience of description, the invention has at least in part been described with respect to a particular orientation, and such terms as top, bottom, side, etc., that relate to orientation shall not be construed as limiting with respect to the claims.

The invention, with explicit and implicit variations and advantages, has been described and illustrated with respect to several embodiments. Those embodiments should be considered illustrative and not restrictive. Any use of words such as "preferred" and variations suggest a feature or combination which is desirable but which is not necessarily mandatory. Thus, embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A grating having a central length axis, for use within an upward-extending riser that comprises a truncated conical wall, comprising:

a hub, centered on said central length axis;

a multiplicity of arms, each arm having a first end attached to the hub, an opposing second end that is a free end, and a length therebetween;

wherein said multiplicity of arms comprises a combination of (a) at least two arms fixedly attached to the hub and un-pivotable in a plane within which lies said central length axis and (b) at least one arm that is wholly or partially pivotable in a plane within which lies said central length axis, to thereby change the distance between the free end thereof and the central length axis;

wherein each arm of said multiplicity of arms increases in circumferential direction width with distance from the hub;

wherein each arm of said multiplicity of arms has a free end that comprises a curved rib; and wherein, the grating has an arch shape in a plane within which lies the central length axis when said at least one arm is pivoted so that the free end thereof is the same distance from the hub as are the free ends of each of said at least two arms fixedly attached to the hub.

2. The grating of claim 1 wherein the whole of said at least one arm is attached to the hub by a hinge, so the whole of said at least one arm pivots in said plane.

3. The grating of claim 2 wherein there is a single at least one arm, the grating configured so that the free ends of all the arms are able to lie around an imaginary circle that lies in a plane perpendicular to the central length axis; and wherein, when said at least one arm is pivoted at the hinge with connects the at least one arm to the hub, there is an about 10 to 30 percent portion of the circumference of said imaginary circle which is characterized by an absence of an arm free end.

4. The grating of claim 1 wherein said at least one arm comprises a first arm part and a second arm part, the first arm part fixedly attached to the hub, the second arm part hingedly connected to the first arm part and comprising said arm free end.

5. The grating of claim 1 wherein said multiplicity of arms consists of five arms.

6. The grating of claim 1 wherein only one arm is wholly or partially hinged.

7. The grating of claim 1 wherein the hub has a through passageway centered on said central length axis.

8. The grating of claim 1 wherein the pivoting of the at least one arm is spring biased.

9. The grating of claim 1 wherein some or all of said multiplicity of arms comprise a circumferentially extending lattice work or solid surface.

10. An assembly comprising:

(a) a grating for impeding the downward passage of small objects when a lid is absent from a riser assembly that comprises a central length axis;

a hub, centered on said central length axis;

a multiplicity of arms extending radially outwardly from the hub, each arm having a first end attached to the hub, an opposing second end that is a free end, and a length therebetween;

wherein at least one arm of said multiplicity of arms is hingedly attached to the hub and thereby wholly or partially pivotable in a plane within which lies said grating central length axis, to thereby change the distance between the arm free end and the grating central length axis;

wherein, when said at least one arm is fully extended, the grating has an arch shape in a plane within which lies the central length axis and the free ends of said multiplicity of for arms lie around a circle; and (b) a first upward-extending riser that comprises a riser central length axis that is substantially parallel to said grating central length axis, a riser first end having an associated first opening that faces downwardly, a riser second end having an associated second opening that faces upwardly, the second opening larger than the first opening;

a circumscribing wall running from the first end to the second end, the wall shaped at least in part as a truncated cone and defining a riser interior space;

wherein the grating is positioned within the riser interior space with the hub is-spaced apart along the riser central length axis from the riser second end;

wherein each grating arm free end is in contact with the truncated cone shaped part of said circumscribing wall; and wherein each grating arm free end extends downwardly from the hub and is closer to said riser first end than is the hub.

11. The assembly of claim 10 wherein the first riser has one or more engagement features in said circumscribing wall part that is shaped as a truncated cone, and wherein each grating arm free end contacts an engagement feature.

12. The assembly of claim 10 wherein two or more of said multiplicity of arms are fixedly attached to the hub and un-pivotable in a plane within which lies said grating central length axis.

13. A method of installing a grating within a riser assembly for impeding the downward passage of small objects when a lid is absent from the riser which comprises:

(i) providing a first riser having a riser central length axis that is substantially vertical and that runs from a riser first end to a riser second end, the riser first end having a first circular opening and associated first diameter, the riser second end having a second opening, the second opening larger than the first opening, and a circumscribing wall running from the first end to the second end, the wall shaped at least in part as a truncated cone and defining a first riser interior space, wherein the second end faces vertically upwardly;

(ii) providing a second riser identical to the first riser and mating the larger opening ends of the first and second risers, wherein the second riser smaller opening faces vertically upward;

(iii) providing a grating comprising a central length axis;

a hub, centered on said central length axis;

a multiplicity of arms extending radially outwardly from the hub, each arm having a first end attached to the hub, an opposing second end that is a free end, and a length therebetween;

wherein at least one arm of said multiplicity is wholly or partially pivotable in a plane within which lies said central length axis, to thereby change the distance between the arm free end and the grating central length axis;

wherein, when said at least one arm is fully extended, the grating has an arch shape in a plane within which lies the grating central length axis and the free ends of said multiplicity of arms lie around a circle that has a diameter greater than said riser first diameter;

(iv) moving the grating vertically downward through the said smaller upward-facing opening of the second riser and into said interior space of the first riser while pivoting said at least one arm in said plane in which lies the grating central length axis, to enable passage of the grating through said smaller upward-facing opening; and, (v) contacting the free end of each grating arm with the truncated cone part of the circumscribing wall of the first riser with the grating central length axis aligned with the riser central length axis, so the grating has an arch shape in a plane within which lies the central length axis of the first riser and so the grating hub is closer to the first riser second opening than are the free ends of the grating.

14. The method of claim 13, wherein the first riser has one or more engagement features on said circumscribing wall within said interior space, spaced apart from the first end of the first riser; and, wherein step (v) further comprises contacting each free end of each arm of the grating with a first riser engagement feature.

* * * * *